US006649124B2

(12) United States Patent
Kohara et al.

(10) Patent No.: US 6,649,124 B2
(45) Date of Patent: Nov. 18, 2003

(54) POWDER PRESSING APPARATUS AND POWDER PRESSING METHOD

(75) Inventors: Seiichi Kohara, Mishima-gun (JP); Shinji Kidowaki, Osaka (JP); Tsutomu Harada, Settsu (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 13 days.

(21) Appl. No.: 09/901,602

(22) Filed: Jul. 11, 2001

(65) Prior Publication Data

US 2002/0006348 A1 Jan. 17, 2002

(30) Foreign Application Priority Data

Jul. 17, 2000 (JP) ..... 2000-216172

(51) Int. Cl.[7] ..... B22F 3/12
(52) U.S. Cl. ..... 419/38; 425/78
(58) Field of Search ..... 419/38; 425/78

(56) References Cited

U.S. PATENT DOCUMENTS 6,299,832 B1 * 10/2001 Kohara et al. ..... 419/38
6,365,094 B1 * 4/2002 Hinzmann et al. ..... 410/38

FOREIGN PATENT DOCUMENTS

| | | | |
|---|---|---|---|
| EP | 1003184 A2 * | 5/2000 | ..... H01F/41/02 |
| JP | 2000-182867 | 6/2000 | |
| JP | 2000-216036 | 8/2000 | |
| JP | 2001-58294 | 3/2001 | |

* cited by examiner

*Primary Examiner*—Daniel J. Jenkins
(74) *Attorney, Agent, or Firm*—Armstrong, Westerman & Hattori, LLP.

(57) ABSTRACT

A powder pressing apparatus comprises a die formed with a plurality of cavities. None of the cavities overlap with another in the direction of pushing the compacts. The magnetic field generator includes a pair of yokes sandwiching the die. The yokes and the die have their respective upper surfaces generally in a same plane. A die lubricant is applied to the die but not to a region on which the compacts are to be slid. A rare-earth alloy powder in a feeder box is supplied into each of the cavities. The powder in the cavities is oriented, pressed, and the formed compacts and the yokes are demagnetized. The compacts are pushed and slid off the die on an anti-wear layer, by a flexible pushing member provided in a front portion of the feeder box. The compacts are sintered into rare-earth magnets, which are suitable for a coreless motor.

17 Claims, 12 Drawing Sheets

74
100
102
104
96
94
26
32
62
56
24
30
80
82
112

POWDER PRESSING APPARATUS AND POWDER PRESSING METHOD

BACKGROUND OF THE INVENTION

1. Field of the Invention

The present invention relates to a powder pressing apparatus and a powder pressing method. More specifically, the present invention relates to a powder pressing apparatus and a powder pressing method for manufacture of a compact to be made into a R—Fe—B magnet.

2. Description of the Related Art

FIG. 12 shows a primary portion of a powder pressing apparatus 1 for pressing a powder into a compact. According to the powder pressing apparatus 1, hollow cylindrical compacts each having, for example, a height of 6.4 mm, an inner diameter of 1.8 mm and an outer diameter of 4 mm are formed.

Now, an operation of the powder pressing apparatus 1 will be described briefly.

First, a die 2 is raised to a predetermined position, whereupon a feeder box 3 is moved above the die 2, allowing the powder contained in the feeder box 3 to fall into cavities 4 of the die 2. The feeder box 3 is then withdrawn, with its lower edge wiping the powder. Thereafter, an upper punch (no illustrated) is lowered to press the powder into compacts in the cavities 4. Then, the upper punch is raised whereas the die 2 is lowered, so that the compacts are out of the die. The compacts are then pushed by a front face 3*a* of the feeder box 3, and slid on the die 2 and a base plate 5 off pressing area.

Since the compacts are soft, pushing by the feeder box 3 is a desirable method of taking out small compacts after the compacting. However, if a number of compacts are pushed as shown in FIG. 12, in a direction of the row of compacts, then the compacts can hit thereby chipping or breaking each other, and the probability increases with the number of compacts in the row. This has limited the number of compacts which can be formed per press, and has been a cause of low productivity.

Alternatively, the compact can be taken out by a robot which is movable in the sliding direction of the feeder box 3. However, it is very difficult for the robot to grasp the small and fragile compact, in a short handling time such as a second or two.

The problem is even more serious in a compact used in manufacture of a Nd—Fe—B magnet, in which the compact is very soft and even more difficult to handle, because the compact is made into a low density for the sake of magnetic property, and a lubricant is added for improved orientation.

SUMMARY OF THE INVENTION

It is therefore an object of the present invention to provide a powder pressing apparatus and a powder pressing method capable of improving yield and productivity.

According to an aspect of the present invention, there is provided a powder pressing apparatus which presses a powder into compacts in a plurality of cavities formed in a die, comprising: powder supply means which supplies the powder into the cavities; orienting means which orients the powder in the cavities; pressing means which presses the powder in the cavities into the compacts; and pushing means which pushes the compacts off the die; wherein none of the cavities overlap with another in a direction of pushing the compacts.

According to another aspect of the present invention, there is provided a powder pressing method for pressing a powder into compacts in a plurality of cavities formed in a die, comprising: a step of supplying the powder into the cavities; a step of orienting the powder in the cavities; a step of pressing the powder in the cavities into the compacts; and a step of pushing the compacts off the die, without allowing any of the compacts to contact another.

In this invention, none of the cavities overlap with another, in the pushing direction of the compacts. Therefore, each of the compacts can be taken out without making contact with another. Thus, yield is improved and productivity can be increased. Even if the compacts are oriented, taking can be performed favorably.

According to still another aspect of the present invention, there is provided a powder pressing apparatus which presses a powder into a compact in a cavity formed in a die, comprising: powder supply means which supplies the powder into the cavity; orienting means which orients the powder in the cavity; pressing means which presses the powder in the cavity into the compact; and pushing means which pushes the compact off the die; wherein the pushing means is provided by a flexible and elastic member.

According to still another aspect of the present invention, there is provided a powder pressing method for pressing a powder into a compact in a cavity formed in a die, comprising: a step of supplying the powder into the cavity; a step of orienting the powder in the cavity; a step of pressing the powder in the cavity into the compact; and a step of pushing the compact off the die, by using a flexible member.

In this invention, since the compact is pushed by the flexible member, pushing force can be applied gradually, instead of all at once, to the compact at the time of pushing. Therefore, even the soft compact can be pushed successfully, without being broken or tipped over.

According to still another aspect of the present invention, there is provided a powder pressing apparatus which presses a powder into a compact in a cavity formed in a die, comprising: powder supply means which supplies the powder into the cavity; orienting means which orients the powder in the cavity; pressing means which presses the powder in the cavity into the compact; pushing means which pushes the compact off the die; and an anti-wear layer provided in a region where the compact pushed by the pushing means slides.

According to still another aspect of the present invention, there is provided a powder pressing method for pressing a powder into a compact in a cavity formed in a die, comprising: a step of supplying the powder into the cavity; a step of orienting the powder in the cavity; a step of pressing the powder in the cavity into the compact; and a step of pushing thereby sliding the compact off the die, on an anti-ware layer.

In this invention, when being pushed, the compact is slid on the anti-wear layer that has a small surface roughness. Therefore, friction force associating with the sliding compact can be reduced, and the compact can be pushed without being broken.

According to still another aspect of the present invention, there is provided a powder pressing apparatus which presses a powder into a compact in a cavity formed in a die, comprising: powder supply means which supplies the powder into the cavity; orienting means which orients the powder in the cavity; pressing means which presses the powder in the cavity into the compact; and pushing means which pushes the compact off the die; and applying means which applies a die lubricant to the die (through-hole) but not to a region where the compact slides.

According to still another aspect of the present invention, there is provided a powder pressing method for pressing a powder into a compact in a cavity formed in a die, comprising: a step of applying a die lubricant to the die but not to a region where the compact slides; a step of supplying the powder into the cavity; a step of orienting the powder in the cavity; a step of pressing the powder in the cavity into the compact; and a step of pushing the compact off the die.

In this invention, since the die lubricant is not applied to the region where the compact is slid, the pushing operation of the compact is not influenced by the die lubricant, and can be performed smoothly.

According to still another aspect of the present invention, there is provided a powder pressing apparatus which presses a powder into a compact in a cavity formed in a die, comprising: powder supply means which supplies the powder into the cavity; orienting means which orients the powder in the cavity, including a pair of yokes sandwiching the die; pressing means which presses the powder in the cavity into the compact; demagnetizing means which demagnetizes the compact and the yokes; and pushing means which pushes the compact off the die.

According to still another aspect of the present invention, there is provided a powder pressing method for pressing a powder into a compact in a cavity formed in a die, comprising: a step of supplying the powder into the cavity; a step of orienting the powder in the cavity by using a pair of yokes sandwiching the die; a step of pressing the powder in the cavity into the compact; a step of demagnetizing the compact and the yokes; and a step of pushing the compact off the die.

In this invention, since the obtained compact and the yokes are demagnetized after the compacting of the powder, the compact can be smoothly slid on the die.

According to still another aspect of the present invention, there is provided a powder pressing apparatus which presses a powder into a compact in a cavity formed in a die, comprising: pressing means which presses the powder in the cavity into the compact; and orienting means which orients the powder in the cavity, including a pair of yokes sandwiching the die; wherein the die and the yokes each has an upper surface generally in a same plane.

In this invention, by forming the upper surfaces of the yokes and the die flush with each other, the orienting means does not interfere with the powder supplying means, thereby increasing freedom in disposition and movement of the powder supplying means. Further, the powder in an upper portion of the cavity can be reliably oriented.

Preferably, the pushing means is provided in the powder supplying means. This arrangement allows to integrate the pushing means with the powder supplying means, into a simple construction. Further, the operations of taking out the compact and supplying the powder into the cavity can be performed almost simultaneously, and operation action can be simplified.

Further, preferably, a feeder box containing the powder therein and having a front portion formed with a pushing means is used, the feeder box is moved on the die for supplying the powder contained in the feeder box into the cavity, while allowing the pushing means to push the compacts off the die. With this arrangement, the powder can be supplied into the cavity while pushing the compact. Therefore, time necessary for a cycle of the pressing operation can be shortened and productivity can be improved.

Further, preferably, the cavities are formed generally in line in a direction generally perpendicular to an orienting direction. With this arrangement, powder in each of the cavities can be oriented in the direction perpendicular to the row of cavities. This makes possible to uniformly magnetize all of the compacts to have the same magnetic characteristic. By sintering these compacts, sintered bodies of a uniform, desired shape can be obtained.

According to this invention, even if the compact to be taken out by sliding is made of a rare-earth alloy powder and therefore is highly fragile, it is possible to prevent damage of the compact and to improve yield.

Also, according to this invention, even if the rare-earth alloy powder is mixed with a lubricant, and therefore the compact is even softer and more susceptible to damage, the present invention is effective since it is possible to prevent damage to the compact.

Compacts made from a rare-earth alloy powder have a small density in order to attain a predetermined level of orientation. According to the present invention, even if the density is low, not smaller than 3.9 g/cm$^3$ and not greater than 4.6 g/cm$^3$, and the compact is highly susceptible to damage, the present invention is effective since it is possible to prevent damage of the compact.

According to the present invention, even if the compact is formed into a hollow member, which is highly fragile and difficult for a robot to grasp for example, the present invention is more effective since it is possible to prevent damage to the compact.

If a magnet obtained by sintering the hollow compact as described above is used in a motor, and the magnet is rotated as a rotor, the magnet is subjected to a very strong force. However, according to the present invention, the magnet has a high quality, and therefore can stabilize the quality of motor.

The above objects, other objects, characteristics, aspects and advantages of the present invention will become clearer from the following description of embodiments to be presented with reference to the accompanying drawings.

DETAILED DESCRIPTION OF THE PREFERRED EMBODIMENTS

Now, embodiments of the present invention will be described with reference to the drawings.

Figure 1:
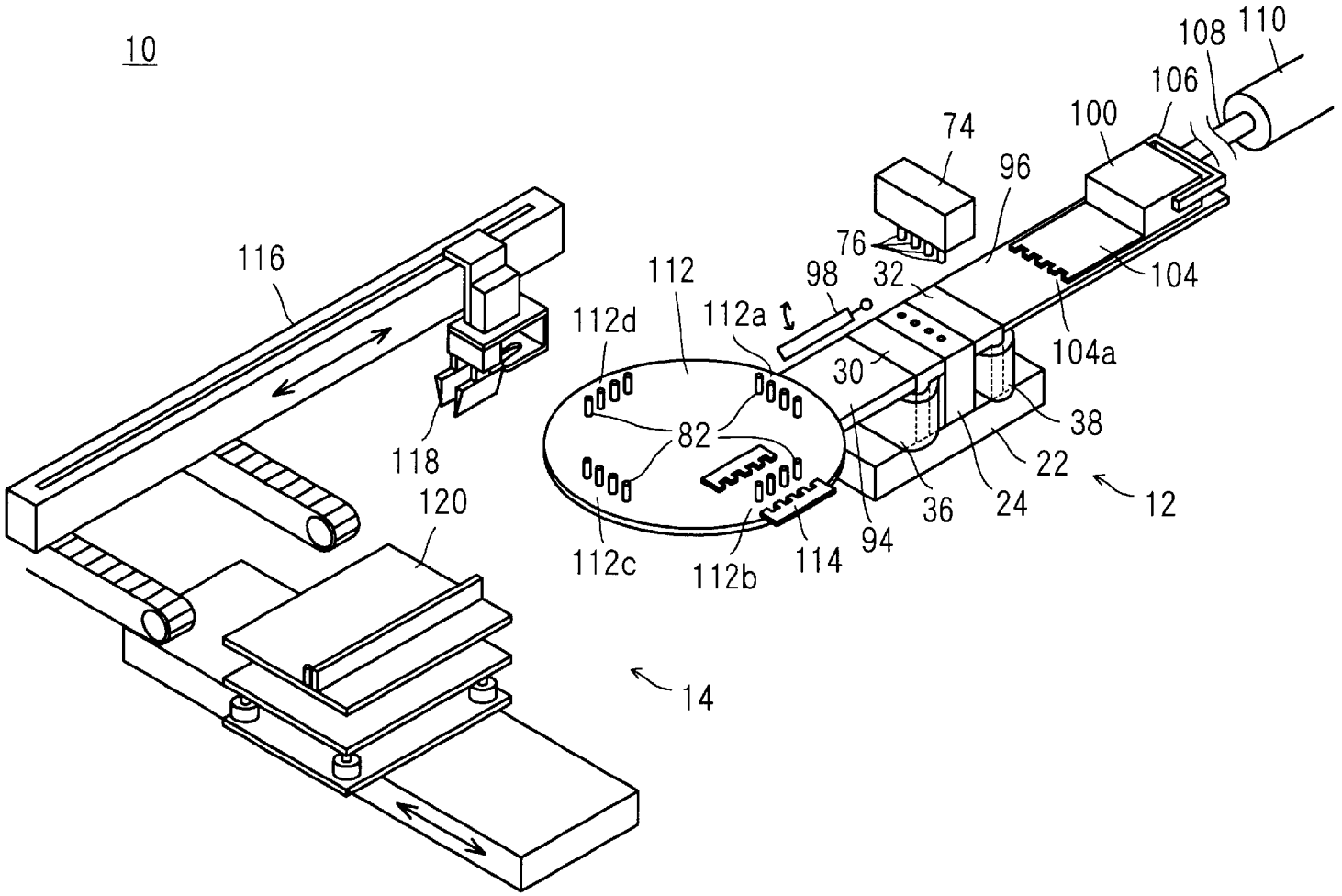
FIG. 1 is a perspective view showing an embodiment of the present invention.

Referring to FIG. 1, a powder pressing apparatus 10 as an embodiment of the present invention comprises a pressing unit 12 which forms compacts 82 (to be described later: See FIG. 6A and FIG. 6B), and a transporting unit 14 which transports the obtained compacts 82.

Figure 2:
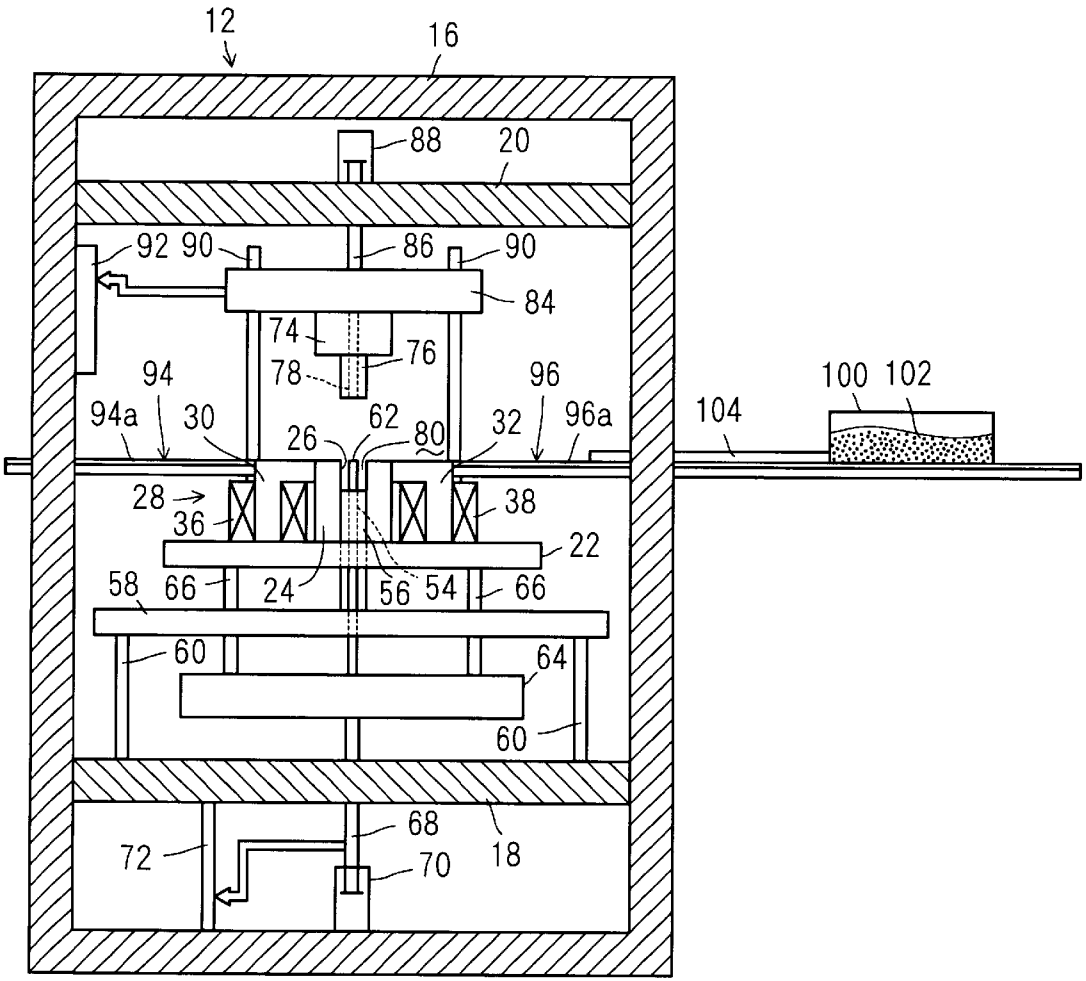
FIG. 2 is a schematic diagram of a pressing unit.

The pressing unit 12 includes a box-like frame 16 as shown in FIG. 2. Inside the frame 16, a punch fixing table 18 and a plate 20 are disposed horizontally at a lower level and at an upper level respectively.

Inside the frame 16, there is disposed a die base 22 made of a material having a high magnetic permeability such as carbon steel. As will be clearly understood from FIG. 3, a die 24 is fixed onto a generally center portion of the die base 22, with screws for example. The die 24 is formed with a plurality (specifically eight according to the present embodiment) of vertical through-holes 26. The through holes 26 are formed in a row longitudinally of the die 24. It should be noted here that although the present embodiment can manufacture eight compacts 82 per press, FIG. 1 illustrates as manufacturing only four compacts 82 for simplicity of the illustration.

Figure 4:
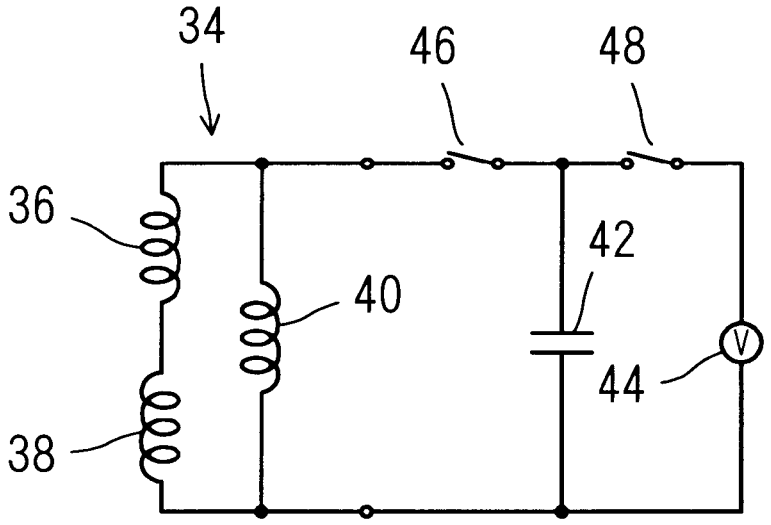
FIG. 4 is a circuit diagram as an example as part of the magnetic field generator.

Closely to the die 24, a magnetic field generator 28 is disposed. On the die base 22, the magnetic field generator 28 includes a pair of yokes 30, 32 each having a section shaped in inverted "L" and disposed in symmetry, with the die 24 in between. The die 24 and the yokes 30, 32 have their respective upper surfaces generally in a same plane (flush). Like the die base 22, the yokes 30, 32 are made of a magnetically highly permeable material such as carbon steel, and are fixed to the die base 22, with screws for example. The magnetic field generator 28 further includes an electric circuit 34 shown in FIG. 4. The electric circuit 34 includes coils 36, 38 would around the yokes 30, 32 respectively. The coils 36, 38 are connected in series, and in parallel therewith, there are provided an additional coil 40, a capacitor 42 and a power source 44 which supplies orienting current.

With the magnetic field generator 28 described as above, a powder 102 in a cavity 80 (both will be described later) can be magnetically oriented, and the compact 82 obtained by pressing as well as the yokes 30, 32 can be demagnetized.

Figure 5:
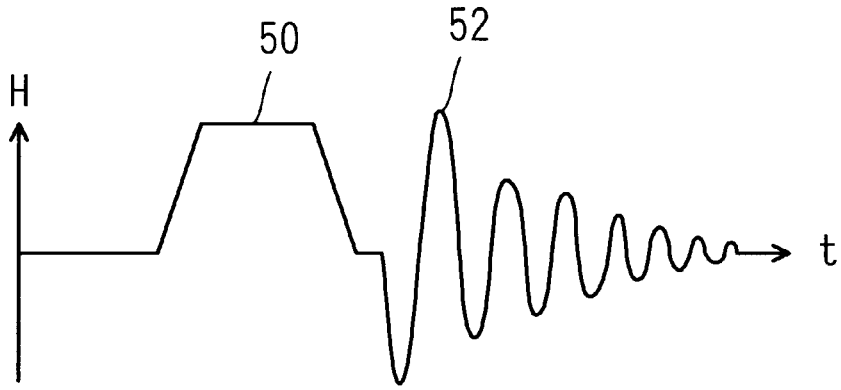
FIG. 5 is a waveform diagram showing an example of magnetic field strength in orientation and demagnetization.

When the magnetic field is applied for orientation, switches 46, 48 are turned on to supply the current to the coils 36, 38. Then, a static magnetic field develops in the direction indicated by Arrow A in FIG. 3, and at the intensity as indicated by reference code "50" in FIG. 5. The power 102 in the cavity 80 is thus oriented. Arrow B in FIG. 3 indicates sliding direction of a feeder box 100 (to be described later). With a magnetic circuit arranged as above, the orienting magnetic field can be applied generally in parallel with the sliding direction, while allowing the pushing member 104 attached to the front portion of the feeder box 100 to push the compacts 82 as after the formation toward the transporting unit 14.

When demagnetizing, the switch 46 in turned on whereas the switch 48 is turned off. This causes the capacitor 42 to repeat charging and discharging, to generate a decremental alternating magnetic field indicated by reference code "52" in FIG. 5, which degenerates the compacts 82 and the yokes 30, 32.

A lower punch 56 having through-holes 54 is inserted in advance into each of the through-holes 26 in the die 24. The lower punch 56 penetrates the die base 22 and stands on the base plate 58. The base plate 58 is disposed on the punch fixing table 18 by poles 60, thereby fixing the lower punch 56.

A rod-like core punch 62 is inserted movably in vertical directions, into each of the through-holes 54 of the lower punch 56. The core punch 62, which penetrates the die base 22 and the base plate 58, has a lower end connected to a connecting plate 64. The die base 22 has a lower surface connected with the connecting plate 64 via guide posts 66. The connecting plate 64 is connected with a lower hydraulic cylinder 70 via a cylinder rod 68. With this arrangement, the die 24, yokes 30, 32 and the core punch 62 are vertically movable by the lower hydraulic cylinder 70. An amount of movement of the cylinder rod 68, i.e. position of the die 24, is measured by a linear scale 72, and based on the measurement, operation of the lower hydraulic cylinder 70 is controlled.

Figure 6A:
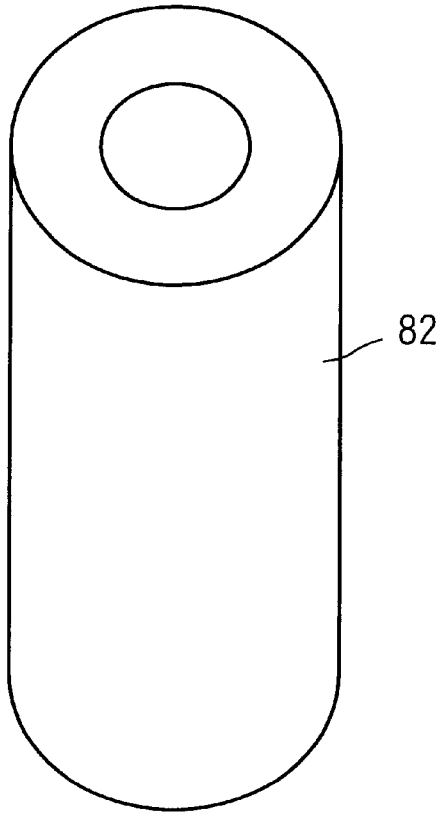
FIG. 6A is a perspective view showing an example of a compact.
Figure 6B:
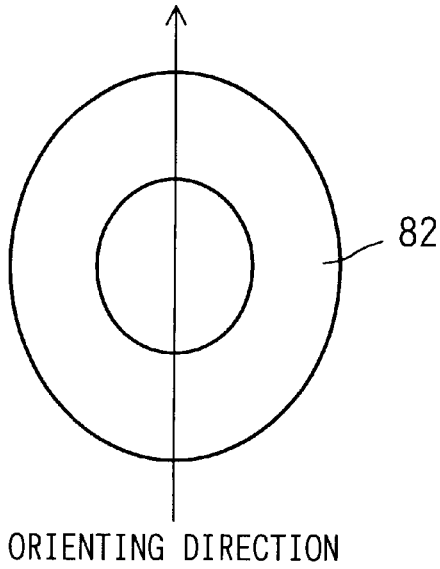
FIG. 6B is a plan view thereof.

Above the die 24, an upper punch 74 is disposed movably in vertical directions. The upper punch 74 has punching portions 76 to be inserted into each of the through-holes 26 of the die 24. Each of the punching portions 76 is formed with a through-hole 78 to mate with the core punch 62. Thus, at the time of compact formation, a tip portion of the core punch 62 projecting out of the lower punch 56 is fitted into the through-hole 78 of the punching portion 76, forming the compact 82 as shown in FIG. 6A in the cavity 80 in each through-hole 26. The compact 82 is utilized for manufacture of a hollow cylindrical magnet for a vibration motor, for example. It should be noted here that in the manufacture of a rare-earth magnet, the magnet is shrunk when sintered, by as much as about 25% in the direction of orientation. In order to compensate for the shrinkage, the compact 82 is formed to have an oval section, elongated in the direction of the orientation as shown in FIG. 6B, so that the resulting rear-earth magnet has a circular section.

The upper punch 74 has an upper end connected with an upper punch plate 84. The upper punch plate 84 is connected with the upper hydraulic cylinder 88 via a cylinder rod 86. The upper hydraulic cylinder 88 is disposed on the plate 20. The upper punch plate 84 has two edge portions penetrated by guide posts 90. The guide posts 90 have their lower ends connected with the die base 22. The upper punch plate 84, guided by the guide posts 90, is vertically movable by the upper hydraulic cylinder 88. An amount of movement of the upper punch plate 84, i.e. position of the upper punch 74, is measured by a linear scale 92, and based on the measurement, operation of the upper hydraulic cylinder 88 is controlled.

The yokes 30, 32 have outer sides provided with base plates 94, 96 respectively. The base plates 94, 96 have upper surfaces flush with the upper surfaces of the yokes 30, 32. The base plates 94, 96 move vertically together with the yokes 30, 32.

The upper surfaces of the base plates 94, 96 are formed with anti-wear layers 94*a*, 96*a* (See FIG. 2) having a small surface roughness. The anti-wear layer 94*a*, 96*a* may be of chrome plating or ceramic thin film for example, a coating of TiN or diamond-like carbon (DLC). The base plate 94 is subject to wear due to sliding action of the feeder box 100 and the pushing member 104. By providing the anti-wear layers 94*a*, 96*a*, surface roughness of the sliding surface can be kept small. Such an anti-wear layer may also be provided in the surface of the die 24. These anti-wear layers are very effective because rare-earth alloy power, which will be described later, includes angular and highly abrasive grains.

Inside walls of the through-holes 26 of the die 24 and inside walls of the cavities 80 are applied with a die lubricant by a discretionary means whether it is automatic or manual. Closely to the upper surfaces of the die 24, yoke 30 and die plate 94, a wiper 98 is provided in order to wipe off the die lubricant from the upper surfaces of the die 24, yoke 30 and die plate 94. After applying the lubricant for example by spraying, the wiper 98 is operated, so that the die lubricant is applied to the die 24 but not to the surface on which the compacts 82 are to be slid. An example of the die lubricant is a fatty ester diluted in a petrol solvent. The lubricant may be applied by using a method disclosed in U.S. patent application Ser. No. 09/421,237.

The feeder box 100 is disposed on the base plate 96. The feeder box 100 contains the powder 102 such as a rear-earth alloy powder. The feeder box 100 has a front portion provided with a plate-like pushing member 104 for pushing the compacts 82. The pushing member 104 is made of a flexible material such as rubber, and has a size of 600 mm long, 5 mm thick and 190 mm wide, for example. The pushing member 104 has a front edge formed with recesses 104*a* corresponding to the through-holes 26, for receiving each of the compacts 82. The feeder box 100 is connected with a hydraulic cylinder 110 via a generally C-shaped connecting member 106 and a cylinder rod 108. Thus, the feeder box 100 can be moved to and from the through-holes 26 by the hydraulic cylinder 110, with the pushing member 104 capable of pushing the compacts 82 on the die 24. The pushing member may be a bar-like member provided separately from the feeder box 100. The pushing member may also be provided by a flexible member made of a thin plate of resin or metal for example.

The compacts 82, which are formed in a predetermined shape and raised onto the die 24 are pushed by the pushing member 104, passing the upper surfaces of the yoke 30 and the base plate 94 to a reception station 112*a* of a turntable 112 of the transporting unit 14. The turntable 112 is rotated by 90 degrees at a time. When the turntable 112 is turned by 90 degrees, the compacts 82 at the reception station 112*a* are moved to a powder-removing station 112*b*. At the powder-removing station 112*b*, a powder-removing device 114 incorporating an air jet generator performs powder removing operation in which the powder sticking around the compacts 82 is blown by $N_2$ gas for example. After the powder-removing operation, the compacts 82 are moved to a waiting station 112*c* in the next 90-degree rotation of the turntable 112, and then to a transporting station 112*d* in another 90-degree rotation. At the transporting station 112*d*, the compacts 82 are grabbed by an air chuck 118 of a transporting robot 116 and moved onto a sintering plate 120. By repeating this cycle of operations, the compacts 82 are sequentially lined up on the sintering plate 120. The compacts 82 on the sintering plate 120 are placed, together with the sintering plate 120, in a sintering pack (not illustrated), transported to a sintering furnace (not illustrated), sintered in the furnace, into magnets.

Now, a manufacturing method of rare-earth alloy powder to be used as the powder 102 will be described.

First, an ingot of an R—Fe—B rare-earth magnet alloy is made by using a known strip cast process. Specifically, an alloy having a composition comprising 30 weight percent Nd, 1.0 weight percent B, 1.2 weight percent Dy, 0.2 weight percent Al, 0.9 weight percent Co, 0.2 weight percent Cu, with the rest of ingredient being Fe and unavoidable impurities is melted by a high-frequency melting process into a molten. The molten is maintained at 1,350° C., and then quenched on a single roll, yielding a mass of flaky alloy having a thickness of about 0.3 mm. Cooling conditions at this time include a roll peripheral speed of about 1 m/s, a cooling rate of 500° C./sec, and a sub-cooling of 200° C. for example.

The thickness of the quenched alloy thus formed varies in a thickness range not thinner than 0.03 mm and not thicker than 10 mm. The alloy includes $R_2T_{14}B$ crystal grains and R-rich phase distributed in grain boundary of the $R_2T_{14}B$ crystal grains. The $R_2T_{14}B$ crystal grains have a size along the short axis not smaller than 0.1 $\mu$m and not greater than 100 $\mu$m, and a size along the long axis not smaller than 5 $\mu$m and not greater than 500 $\mu$m. The R-rich phase has a thickness not greater than 10 $\mu$m. A manufacturing method of the raw material alloy by using the strip cast process is disclosed in the U.S. Pat. No. 5,383,978 for example.

Next, the obtained alloy flake is coarsely pulverized and packed in a plurality of raw material packs, which are then loaded on a rack. Thereafter, a material transporting device transports the rack loaded with the raw material packs to a hydrogen furnace, and the packs are placed in the hydrogen furnace, where a hydrogen occlusion pulverizing is performed. Specifically, the raw material alloy is heated and pulverized in the hydrogen furnace. After pulverizing, the raw material is taken out, preferably after the raw material alloy has been cooled down to a room temperature. However, even if the raw material is taken out at a higher temperature (such as 40° C. to 80° C.), no serious oxidization takes place unless the raw material is exposed to the atmosphere. The hydrogen occlusion pulverizing yields the rare-earth alloy coarsely pulverized into the size of 0.1 mm to 1.0 mm approximately. It should be noted here that the alloy should preferably be coarsely pulverized into flakes having an average grain diameter of 1 mm to 10 mm before the hydrogen occlusion pulverizing.

After the hydrogen occlusion pulverizing, the embrittled raw material alloy should preferably be cracked finer while being cooled, by using a cooling apparatus such as a rotary cooler. If the raw material is taken out at a relatively high temperature, a relatively longer time should be allocated for the cooling operation by the rotary cooler for example.

The raw material powder which is thus cooled down to a room temperature by the rotary cooler for example is then further milled by a jet mill for example, into a fine powder. According to the present embodiment, the fine milling is performed by a jet mill in a nitrogen atmosphere, and an alloy powder having an average grain diameter (Mass Median Diameter, MMD) of approximately 3.5 $\mu$m was obtained. It is preferable that the amount of oxygen in the nitrogen atmosphere be maintained at a low level, at around 10000 ppm for example. Such a jet mill as the above is disclosed in Japanese Patent Publication (of examined Application for opposition) No. 6-6728. Preferably, concentration of oxidizing gas (such as oxygen and moisture) contained in the atmosphere during the fine milling is controlled, whereby oxygen content (weight) in the finely milled alloy powder is controlled not greater than 6000 ppm. If the oxygen content in the rare-earth alloy powder is excessive, i.e. beyond 6000 ppm, then the magnet contains non-magnetic oxide at a high rate, which deteriorates magnetic characteristic of the resulting sintered magnet.

Next, the alloy powder is mixed with 0.3 weight percent, for example, of a lubricant in a rocking mixer, so that surfaces of the alloy powder particle are coated with the lubricant. The lubricant can be a fatty acid ester diluted with a petrol solvent. According to the present embodiment, capronic acid methyl is used as the fatty acid ester, and isoparaffin is used as the petrol solvent. Weight ratio of the capronic acid methyl to isoparaffin is 1:9 for example. Such a liquid lubricant covers the powder particle surfaces, protects the particles from oxidization, and allows the powder to be pressed into the compact having a uniform density, as well as lessening irregularity in the orientation.

The kind of the lubricant is not limited to the above-mentioned. For example, in addition to capronic acidmethyl, usable fatty ester includes capric acid methyl, lauryl acid methyl, and lauric acid methyl. As for the solvent, isoparaffin is representative but many others can be selected from petrol solvents, as well as naphthene and other solvents. The solvent may be added at a discretionary timing, i.e. before, during or after the fine milling. Further, a solid (dry) lubricant such as zinc stearate can be used alternatively to or together with the liquid lubricant.

Next, with reference to FIG. 7A to FIG. 7H, an operation of the powder pressing apparatus 10 will be described.

Figures 7A, 7B, 7C, 7D, 7E, 7F, 7G, 7H:
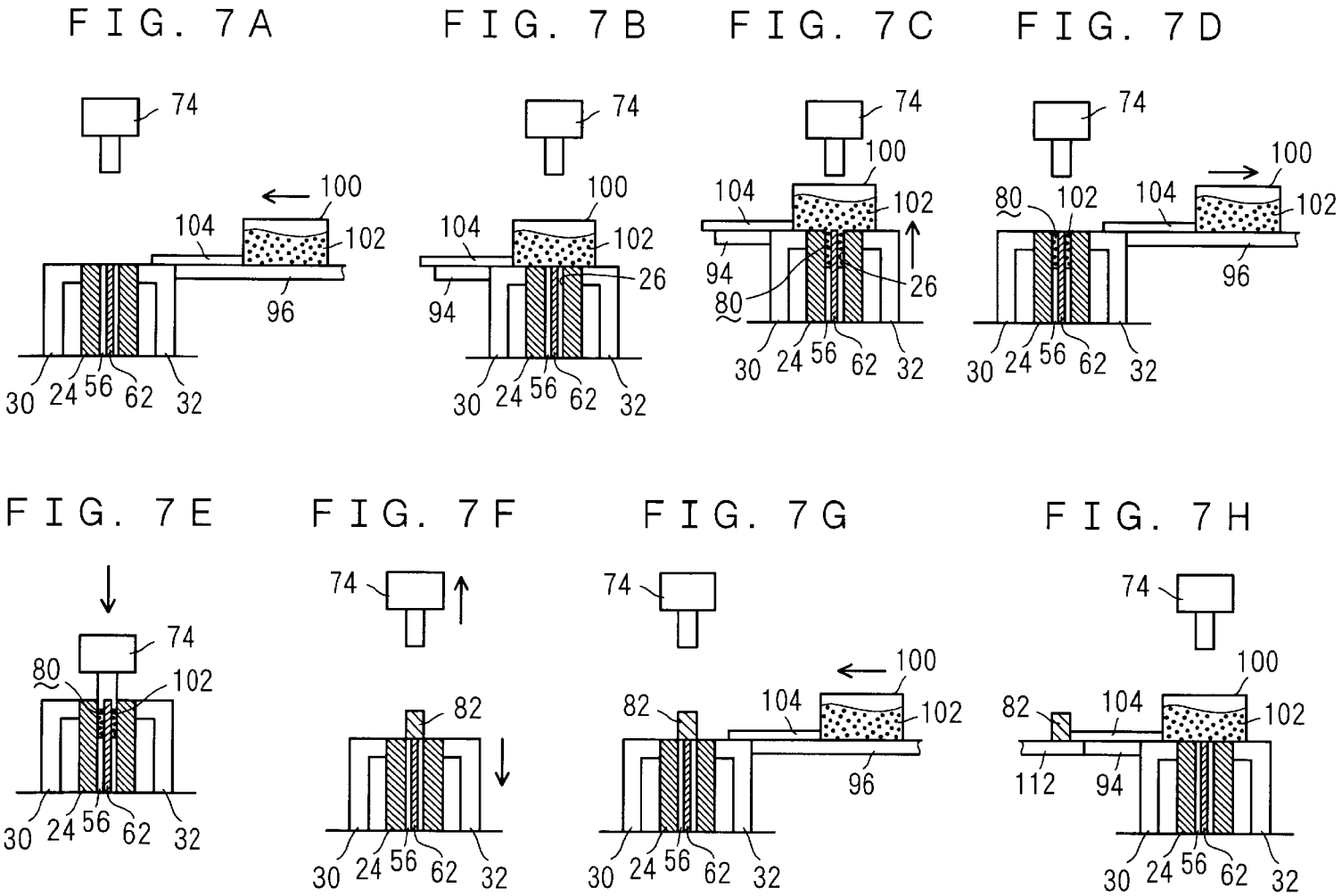
FIG. 7A to FIG. 7H illustrate an example of operation according to the embodiment.

First, as shown in FIG. 7A, the die 24 and the core punch 62 are at their lower end of stroke, whereas the upper punch 74 is its upper end of stroke. The die 24, the lower punch 56 and the core punch 62 have their respective upper surfaces flush with each other. In this state, the feeder box 100 slides toward the die 24, and as shown in FIG. 7B, the feeder fox 100 stops above the through-hole 26. Then, as shown in FIG. 7C, the die 24 and the core punch 62 begin rising to form the cavity 80 at an upper portion of the through-hole 26, and the powder 102 in the feeder box 100 falls into the cavity 80. Next, when the die 24 and the core punch 62 reach their upper end of stroke, as shown in FIG. 7D, the feeder box 100 is withdrawn from above the cavity 80, when the lower edge of the feeder box 100 wipes off the power 102 above the cavity 80.

Then, as shown in FIG. 7E, the upper punch 74 is lowered into the through-hole 26 (the cavity 80), the powder 102 in the cavity 80 is magnetically oriented, and the power 102 is pressed by the upper punch 74 and the lower punch 56 into the compact 82. The compact 82 and the yokes 30, 32 are then demagnetized.

Then, as shown in FIG. 7F, the upper punch 74 is raised whereas the die 24 and the core punch 62 is lowered, exposing the compact 82 on the lower punch 56. Then, as shown in FIG. 7G, the feeder box 100 is slid toward the die 24, and as shown in FIG. 7H, the pushing member 104 provided in the front portion of the feeder box 100 pushes the compact 82 whereas the feeder box 100 is stopped above the through-hole 26. In other words, when the feeder box 100 reaches above the through-hole 26 for feeding the powder, the compact 82 has been pushed onto the turntable 112 by the pushing member 104. Thereafter, the above operations in FIG. 7C to FIG. 7H are repeated. The die lubricant is applied at a predetermined interval to the die 24 but not on the surface slid by the compact 82.

According to the powder pressing apparatus 10, none of the cavities 80 overlap with another in the pushing direction of the compacts 82. Therefore, each of the compacts 82 can be taken out without contacting the other compacts 82. Therefore, yield can be improved and productivity can be increased. Further, since the compacts 82 can be quickly taken out of the forming area, cycle time per press can be shortened.

Further, the pushing member 104, made of a flexible material, flexibly deforms when contacting the compacts 82 during the pushing. Therefore, pushing force can be applied gradually to the compacts 82, instead of all at once. Therefore, even the soft compacts can be pushed successfully, without being broken or tipped over.

Further, when being pushed, the compacts 82 slide on the anti-wear layer 94*a* which has a small surface roughness, and therefore friction force associating with the sliding compacts 82 can be reduced, facilitating the pushing operation without breaking the compacts 82.

Normally, the application of the die lubricant is made by spraying from above the cavities 80. According to the powder pressing apparatus 10, the die lubricant is selectively applied to side surfaces of the through-holes 26 or sprayed entirely to the cavities 80, and then wiped by the wiper 98 for example, so that the die lubricant is not left on the surface to be slid by the compacts 82. Therefore, the pushing operation of the compacts is not influenced by the die lubricant, and can be performed smoothly.

When the powder 102 in the cavity 80 is pressed into a compact, the powder 102 in the cavity 80 is oriented by the pair of yokes 30, 32 sandwiching the die 24. However, if not demagnetized thereafter, the compact 82 and the yokes 30, 32 remain magnetized in the direction of the orienting magnetic field. If the magnetism remains in the compact 82 and the yokes 30, 32, when the compacts 82 are slid on the yoke 30, the compacts 82 that contact directly with the yoke 30 are magnetically attracted strongly by the yoke 30. Also, the compact 82 and the yoke 30 repel each other, potentially causing the compact 82 to tip over. These situations make difficult to take the compact 82 off the die 24. By contrast, according to the powder pressing apparatus 10, after the powder 102 is pressed into the compact, the obtained compact 82 and the yokes 30, 32 are demagnetized almost completely by using the alternating decremental magnetic field. Therefore, the compact 82 can be taken off the die 24 smoothly.

Further, according to the powder pressing apparatus 10, the pushing member 104 and the feeder box 100 can be integrated with each other, into a simple construction. Further, the compacts 82 can be pushed out while the powder 102 is supplied into the cavity 80. Since the two operations of taking out the compact 82 and supplying the powder into the cavity 80 can be performed almost simultaneously, time necessary for a cycle of the pressing can be shortened, and productivity can be improved.

The yokes 30, 32 and the die 24 have their respective upper surfaces flush with each other at the time of powder supply. With this arrangement, the magnetic field generator 28 does not interfere with the feeder box 100, thereby increasing freedom in disposition and movement of the feeder box 100. Further, the powder 102 in an upper portion of the cavity 80 can be reliably oriented.

Still further, the powder 82 in each of the cavities 80 can be oriented in the direction perpendicular to the row of cavities 80. This makes possible to uniformly magnetize all of the compacts 82 to have the same magnetic characteristic when orienting magnetic field is applied. By sintering these compacts 82, sintered bodies of a uniform, desired shape and magnetic property can be obtained.

Even if the compacts 82 are made of a rare-earth alloy powder and is highly fragile, it is possible to prevent damage to the compacts 82 and to improve yield.

Still further, even if the rare-earth alloy powder is mixed with a lubricant for improved orientation, and thus the compacts 82 are even softer and more susceptible to damage, it is possible to prevent damage to the compacts 82. Likewise, even if the compacts 82 have a low density, ranging from 3.9 g/cm$^3$ to 4.6 g/cm$^3$, and therefore are susceptible to damage, it is possible to prevent damage to the compacts 82.

Still further, even if the compacts 82 are formed into a hollow member, which is highly fragile and difficult for a robot to grasp for example, it is possible to prevent damage of the compacts 82.

In fact, smaller compacts 82 are more susceptible to damage and more difficult for a robot for example to grasp.

However, according to the powder pressing apparatus 10, the compacts 82 are not grasped but pushed so as not to hit each other. Therefore, risk of breaking the compacts 82 is low even if the compacts 82 are small. Therefore, the powder pressing apparatus 10 is more effective when the compacts 82 are smaller.

Figure 8:
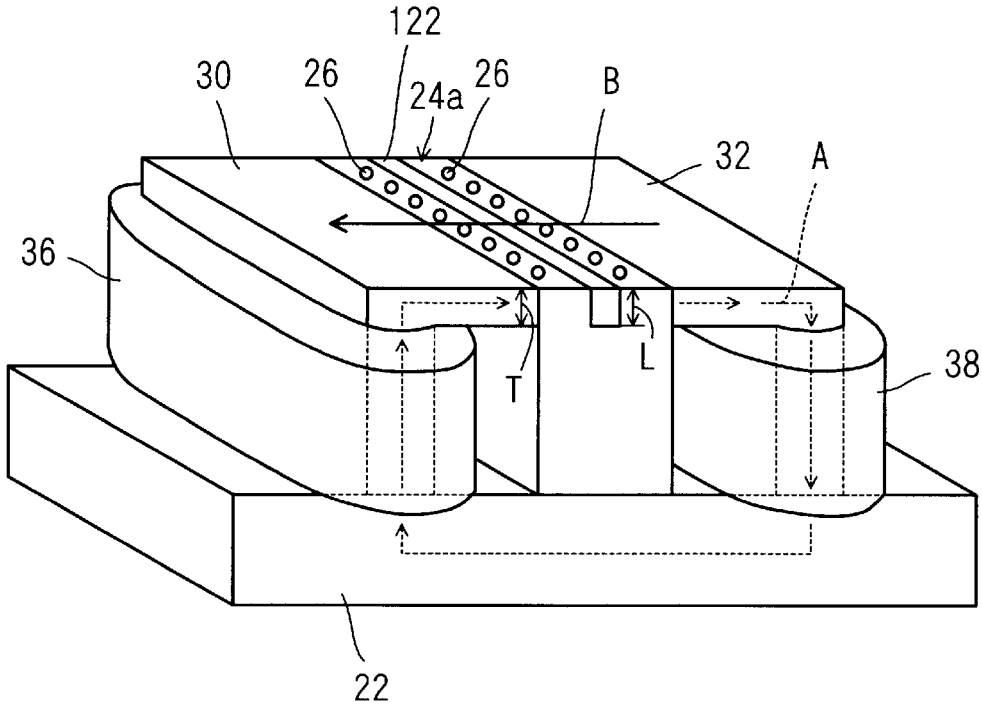
FIG. 8 is a perspective view showing another example of the die and magnetic field generator on the die base.

It should be noted that a die 24*a* as shown in FIG. 8 may be used.

Figure 9:
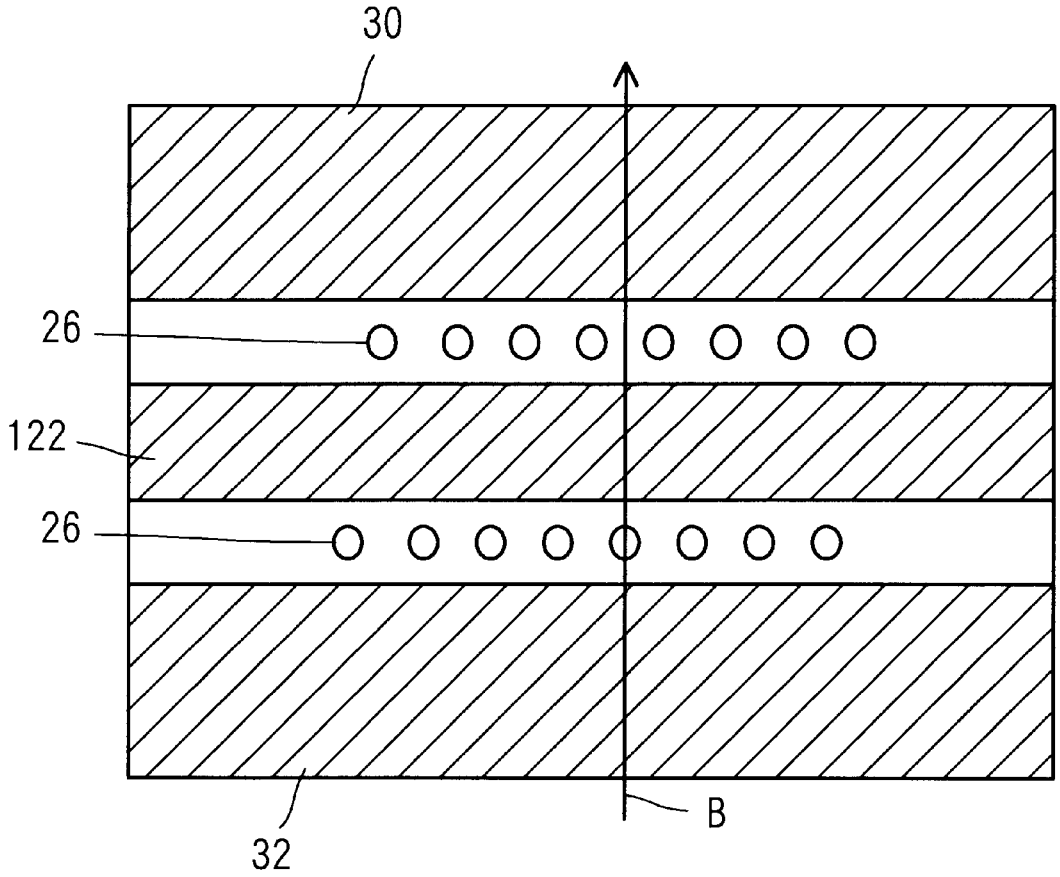
FIG. 9 is diagram showing a layout of through-holes in the die shown in FIG. 8.

The die 24*a* has an upper surface formed with two longitudinal rows of through-holes 26. As will be clearly understood from FIG. 9, none of the through-holes 26 overlap with another in a direction of transportation of the feeder box 100 indicated by Arrow B. Further, in order to prevent the magnetic flux from being bent, as shown in FIG. 8 and FIG. 9, an assisting yoke 122 which is made of a magnetic material with high permeability such as carbon steel is provided between the two rows of the through-holes 26. In order to prevent the orienting magnetic field from being bent toward the pressing direction, the assisting yoke 122 should preferably have a dimension L in the pressing direction that is generally equal to a thickness T of the yokes 30, 32 in the pressing direction.

With the die 24*a*, it becomes possible to increase the number of compacts 82 to be formed at one time, without causing the compacts 82 to hit each other during the pushing operation.

Figure 10:
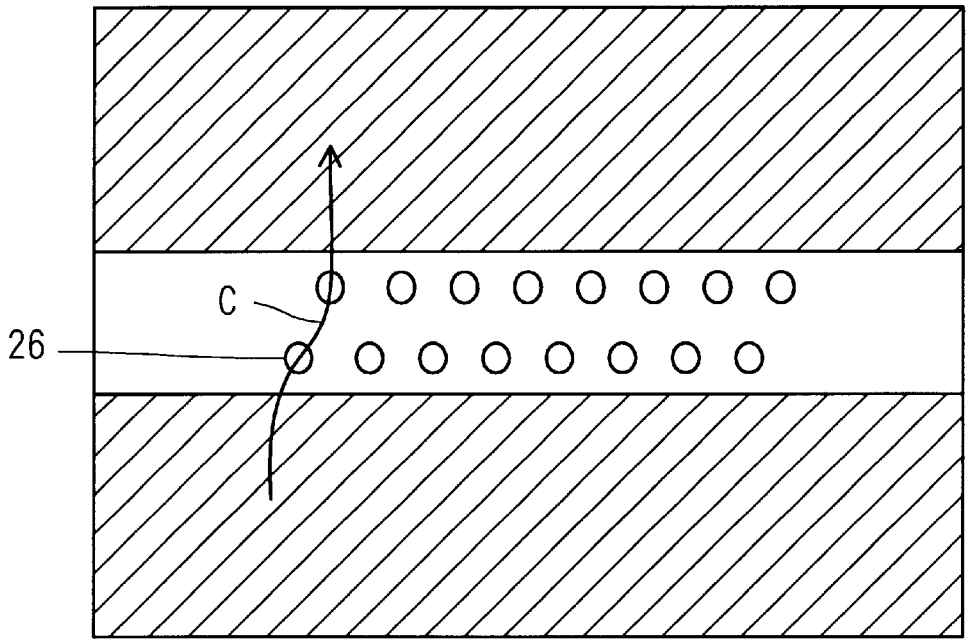
FIG. 10 is a diagram showing an example of magnetic flux passing through the through-holes of the die.

It should be noted here that the die 24*a* is non-magnetic, except for the assisting yoke 122, but the cavities 80 become magnetic once the through-holes 26 are filled with the powder 102, and therefore the magnetic flux concentrates on the cavities 80. For this reason, if the through-holes 26 are formed in a zigzag pattern as shown in FIG. 10 for example, the flow of magnetic flux is bent as indicated by Arrow C. Thus, the obtained compacts are not oriented in the desired direction, and the level of orientation in each compact is not uniform. Therefore, magnets obtained by sintering these compacts do not have the desirable circular section, but have an oval section or deformed shape, or they can even crack or chip.

On the contrary, as shown in FIG. 8 and FIG. 9, by placing the assisting yoke 122 between the two rows of through-holes 26, it becomes possible to eliminate mutual interference between a row of the through-holes 26 and the other row of the through-holes 26, and to lessen the bend in the magnetic flux passing through the through-holes 26. Therefore, even if the through-holes 26 are formed in a zigzag pattern, deflection in the orientation of the obtained compacts 82 can be reduced. As a result, magnets obtained by sintering these compacts 82 can be used for a coreless motor 200 (to be described later).

If the compacts 82 are made of a rare-earth alloy powder, the compacts 82 are made into sintered rare-earth magnets, by being sintered at a temperature of 1000° C. to 1200° C. in an argon atmosphere for two hours. The sintered rare-earth magnets are hollow cylindrical for example, with 1.7 mm inner diameter, 2.5 mm outer diameter and 6.5 mm height.

Figure 11:
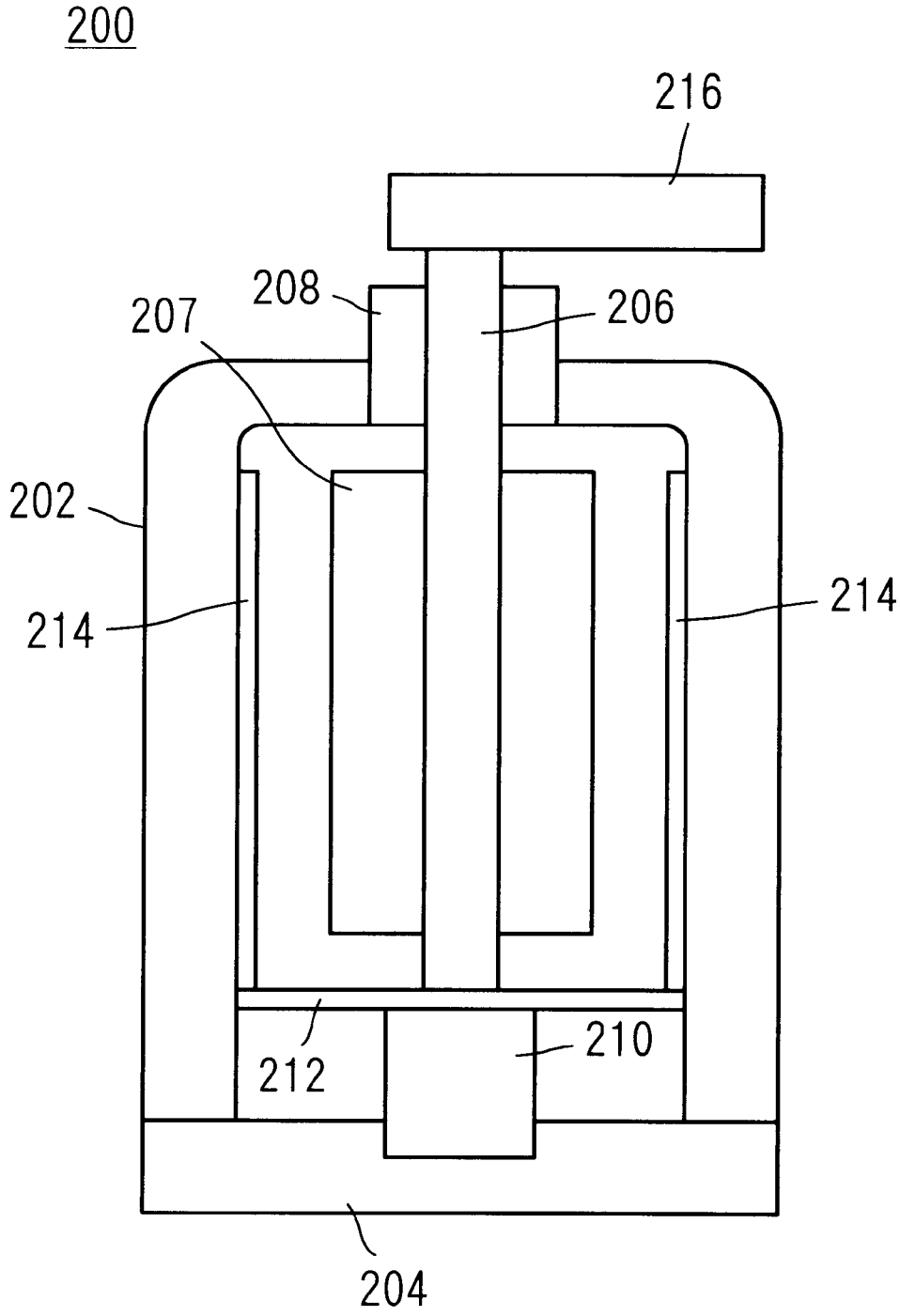
FIG. 11 is a diagram showing an example of a coreless motor.

The sintered rare-earth magnets then receive surface-treatment such as Ni plating, to become rare-earth magnets, which can be used for example in the miniature coreless motor 200 as shown in FIG. 11.

The coreless motor 200 is used as a vibration motor for example, and includes a frame case 202. The frame case 202 has an upper center opening and a lower opening. The lower opening is provided with a bracket 204. A shaft 206 is placed in the frame case 202. The shaft 206 is fitted into a hollow cylindrical rare-earth magnet 207. The shaft 206 has an end portion supported by a bearing 208 fitted into the upper center opening of the frame case 202. The shaft 206 has another end portion provided with a switching unit 210 incorporating a commutator (not illustrated). The shaft 206 is mounted on the bracket 204 via an unillustrated bearing. Therefore, the shaft 206 and the rare-earth magnet 207 are rotatably supported. Also, a substrate 212 is fixed in the frame case 202. The substrate 212 is mounted with a pair of coils 214 facing the rare-earth magnet 207. The shaft 206 has its upper end provided with a weight (eccentric weight) 216. In the coreless motor 200, the shaft 200 and the rare-earth magnet 207 are rotated by the magnetic flux generated when electricity is applied to the coils 214.

The rare-earth magnet 207 manufactured as described above, in the coreless motor 200 can stabilize quality of the coreless motor 202 since the rare-earth magnet 207 has a stable quality.

Next, an experiment will be described.

Figure 12:
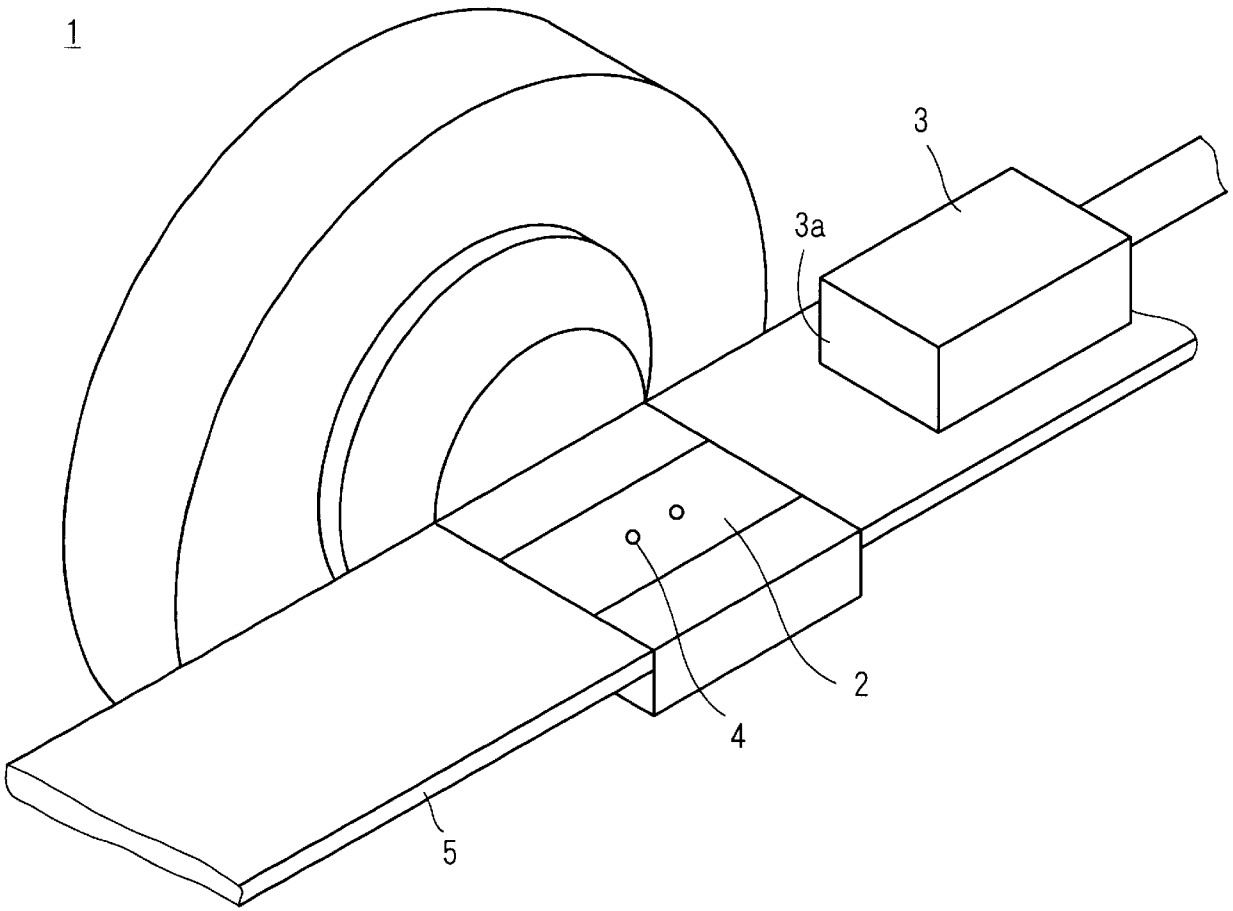
FIG. 12 RELATED ART
FIG. 12 is a perspective view showing a related art.

According to the prior art apparatus shown in FIG. 12, a maximum number of compacts which could be manufactured per hour was 360.

Then, in the prior art apparatus shown in FIG. 12, the die 2 and the punches were replaced so that four compacts could be formed in a line. This arrangement allowed the apparatus to manufacture 720 compacts per hour. However, since the compacts were taken out by been pushed by the front portion 3*a* of the feeder box 3, seventy compacts out of the 720 were broken by mutual hitting during the sliding, and yield was lowered.

Figure 3:
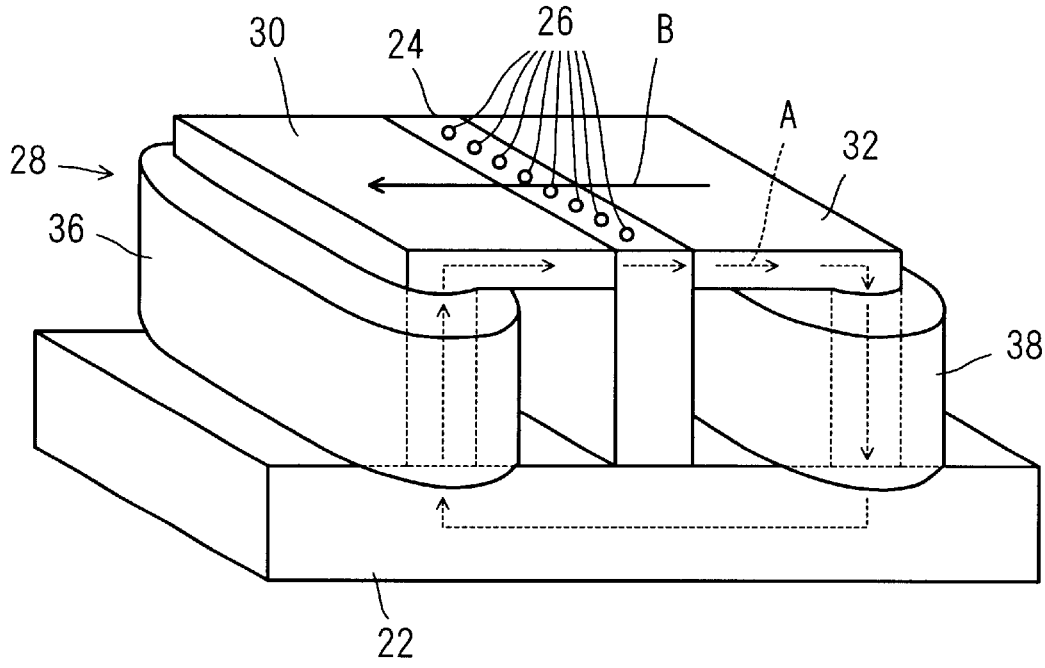
FIG. 3 is a perspective view showing a die and a magnetic field generator on a die base.

On the other hand, when the manufacture was made with the unit shown in FIG. 3 for an hour, the number of compacts manufactured was 1700, including 15 deficient ones. Likewise, when the manufacture was made with the unit shown is FIG. 8 for an hour, the number of compacts manufactured was 3400, including 38 deficient ones.

As exemplified as above, according to the powder pressing apparatus 10, yield of the compacts can be improved and productivity can be increased.

It should be noted here that according to the above embodiment, the yokes 30, 32 have a section shaped in inverted "L" and are provided on the die base 22. The present invention is not limited to this however. For example, each of the yokes 30, 32 may be divided into a horizontal member and a vertical member, the horizontal members may be formed integrally with the die 24, whereas the vertical members may be connected to the upper punch 74, and the coils may be wound around the vertical members. With this arrangement, when the upper punch 74 is lowered, the vertical members are connected to the respective horizontal members to form a magnetic circuit, then the powder in the cavities is oriented, and the obtained compacts and horizontal members are demagnetized.

Further, the pushing member 104 may be provided separately from the feeder box 100, as disclosed for example in U.S. patent application Ser. No. 09/560,352.

Further, the cavities 80 maybe supplied with the powder by an individual feeding method.

Still further, the upper surface of the base plate 96 may not necessarily be provided with the anti-wear layer 96*a*.

According to the present embodiments, the description covers formation of the hollow cylindrical compacts. However, the present invention can also be applied to forming of small cubic compacts.

The present invention being thus far described and illustrated in detail, it is obvious that these description and drawings only represent an example of the present invention, and should not be interpreted as limiting the invention. The spirit and scope of the present invention is only limited by words used in the accompanied claims.

What is claimed is:

1. A powder pressing apparatus which presses a powder into a compact in a cavity formed in a die, comprising:

powder supply means which supplies the powder into the cavity;

orienting means which orients the powder in the cavity;

pressing means which presses the powder in the cavity into the compact; and pushing means which pushes the compact off the die; wherein the pushing means is a flexible member.

2. A powder pressing apparatus which presses a powder into a compact in a cavity formed in a die, comprising:

powder supply means which supplies the powder into the cavity;

orienting means which orients the powder in the cavity;

pressing means which presses the powder in the cavity into the compact;

pushing means which pushes the compact off the die;

a base plate located adjacent to and coplanar with a top edge of the die; and an anti-wear layer provided on the base plate where the compact pushed by the pushing means slides.

3. A powder pressing apparatus which presses a powder into a compact in cavity formed in a die, comprising:

powder supply means which supplies the powder into the cavity;

orienting means which orients the powder in the cavity;

pressing means which presses the powder in the cavity into the compact;

pushing means which pushes the compact off the die; and applying means which applies a die lubricant to the die but not to a region where the compact slides;

wherein the applying means includes a wiper for wiping off the die lubricant from the region where the compact slides.

4. A powder pressing apparatus which presses a powder into a compact in a cavity formed in a die, comprising:

powder supply means which supplies the powder into the cavity;

orienting means which orients the powder in the cavity, including a pair of yokes sandwiching the die;

pressing means which presses the powder in the cavity into the compact;

demagnetizing means which demagnetizes the compact and the yokes by using a decremental alternating magnetic field; and pushing means which pushes the compact off the die.

5. The apparatus according to one of claims 1 to 4, wherein the pushing means is provided in the powder supplying means.

6. The apparatus according to one of claims 1 to 4, wherein the orienting means includes a pair of yokes sandwiching the die, the die and the yokes each having an upper surface generally in a same plane.

7. The apparatus according to one of claims 1 to 4, wherein the powder is a rare-earth alloy powder.

8. The apparatus according to claim 7, wherein the rare-earth alloy powder is mixed with a lubricant.

9. The apparatus according to claim 7, wherein the compact is formed to have a density of not smaller than 3.9 $g/cm^3$ and not greater than 4.6 $g/cm^3$.

10. The apparatus according to one of claims 1 to 4, wherein the compact is hollow.

11. A motor comprising a magnet obtained by sintering the compact produced by the apparatus of claim 10.

12. A powder pressing method for pressing a powder into a compact in a cavity formed in a die, comprising:

a step of supplying the powder into the cavity;

a step of orienting the powder in the cavity;

a step of pressing the powder in the cavity into the compact; and a step of pushing the compact off the die with a flexible member.

13. A powder pressing method for pressing a powder into a compact in a cavity formed in a die, comprising:

a step of supplying the powder into the cavity;

a step of orienting the powder in the cavity;

a step of pressing the powder in the cavity into the compact; and a step of pushing thereby sliding the compact off the die and across an adjacent base plate, over an anti-wear layer provided in the base plate.

14. A powder pressing method for pressing a powder into a compact in a cavity formed in a die, comprising:

a step of applying a die lubricant to the die;

a step of wiping off a region where the compact slides;

a step of supplying the powder into the cavity;

a step of orienting the powder in the cavity;

a step of pressing the powder in the cavity into the compact; and a step of pushing the compact off the die.

15. A powder pressing method for pressing a powder into a compact in a cavity formed in a die, comprising:

a step of supplying the powder into the cavity;

a step of orienting the powder in the cavity by using a pair of yokes sandwiching the die;

a step of pressing the powder in the cavity into the compact;

a step of demagnetizing the compact and the yokes by using a decremental alternating magnetic field; and a step of pushing the compact off the die.

16. The method according to one of claims 12 to 15, further comprising the step of repeating the steps for a plurality of cycles, wherein the method uses a feeder box containing powder therein and having a front portion formed with a pushing means, such that the steps of supplying powder into the cavity on one cycle and pushing the compact produced in a previous cycle off the die are effected by the motion of the feeder box.

17. The method according to one of claims 12 to 15, wherein the powder is a rare-earth alloy powder.

* * * * *